US007393025B2

(12) United States Patent
Kennedy et al.

(10) Patent No.: US 7,393,025 B2
(45) Date of Patent: Jul. 1, 2008

(54) MINE DOOR SYSTEM WITH TRIGGER-ACTUATED LATCH MECHANISM

(75) Inventors: William R. Kennedy, Taylorville, IL (US); John M. Kennedy, Taylorville, IL (US)

(73) Assignee: Kennedy Metal Products & Buildings, Inc., Taylorville, IL (US)

( * ) Notice: Subject to any disclaimer, the term of this patent is extended or adjusted under 35 U.S.C. 154(b) by 700 days.

(21) Appl. No.: 10/706,190

(22) Filed: Nov. 12, 2003

(65) Prior Publication Data

US 2005/0099020 A1 May 12, 2005

(51) Int. Cl.
*E05B 63/20* (2006.01)

(52) U.S. Cl. ..... 292/332; 292/221; 292/219

(58) Field of Classification Search ..... 292/219, 292/221, 226, 203, 229, 52, 53, 57, 196, 292/332, 58, 71, 66, 223, 228, 227, 341.15, 292/129, 177
See application file for complete search history.

(56) References Cited

U.S. PATENT DOCUMENTS

| | | | | | |
|---|---|---|---|---|---|
| 2,507,196 | A | * | 5/1950 | Dall | 292/99 |
| 2,627,435 | A | * | 2/1953 | Borrup | 292/332 |
| 2,679,427 | A | * | 5/1954 | Johnson | 292/332 |
| 2,741,505 | A | | 4/1956 | Courney | |
| 2,804,329 | A | * | 8/1957 | Landis | 292/170 |
| 3,968,984 | A | * | 7/1976 | Guth | 292/229 |
| 4,082,331 | A | | 4/1978 | Kennedy et al. | |
| 4,118,894 | A | | 10/1978 | Kennedy et al. | |
| 4,373,294 | A | | 2/1983 | Kennedy et al. | |
| 4,478,535 | A | | 10/1984 | Kennedy et al. | |
| 4,523,406 | A | | 6/1985 | Kennedy et al. | |
| 4,548,435 | A | * | 10/1985 | Bourne | 292/229 |
| 4,632,440 | A | * | 12/1986 | Adrian et al. | 292/229 |
| 4,693,503 | A | * | 9/1987 | Bisbing | 292/210 |
| 4,875,721 | A | * | 10/1989 | Okamoto et al. | 292/29 |
| 5,168,667 | A | | 12/1992 | Kennedy et al. | |
| 5,240,349 | A | | 8/1993 | Kennedy et al. | |
| 5,307,788 | A | | 5/1994 | Peck | |
| 5,638,709 | A | * | 6/1997 | Clavin | 70/208 |
| 5,927,012 | A | | 7/1999 | Cermola et al. | |
| 6,032,986 | A | | 3/2000 | Kennedy et al. | |
| RE36,853 | E | | 9/2000 | Kennedy et al. | |
| 6,164,871 | A | | 12/2000 | Kennedy et al. | |
| 6,425,820 | B1 | | 7/2002 | Kennedy et al. | |
| 6,457,906 | B1 | | 10/2002 | Kennedy et al. | |
| 6,502,872 | B1 | | 1/2003 | Molzer | |
| 6,594,954 | B1 | | 7/2003 | Kennedy et al. | |

* cited by examiner

*Primary Examiner*—Patricia Engle
*Assistant Examiner*—Kristina R Fulton
(74) *Attorney, Agent, or Firm*—Senniger Powers LLP

(57) ABSTRACT

A mine door system for closing a mine doorway comprises a door hinged adjacent the doorway for swinging relative to the stopping between a closed position and an open position swung outwardly away from the stopping. A keeper is mounted in fixed position relative to the doorway. The system further comprises a trigger-actuated latch mechanism including a detent engageable with the keeper for latching the door in its closed position and a trigger operably connected to the detent in a latched position. The mechanism is constructed and configured so that actuation of the trigger causes the detent to move from a latched position in which the detent engages the keeper for latching the door closed to an unlatched position in which the detent is disengaged from the keeper for allowing the door to be opened.

29 Claims, 11 Drawing Sheets

MINE DOOR SYSTEM WITH TRIGGER-ACTUATED LATCH MECHANISM

BACKGROUND OF THE INVENTION

This invention relates generally to doors for mine stoppings and more particularly to latch mechanisms for such doors.

Stoppings are widely used in mines to block off the flow of air through some mine passageways. It is often desired that such stoppings be provided with a door for occasional access to the blocked-off passageway. A problem is encountered, however, in providing a door for a stopping because the floors of passages in mines often heave up or otherwise shift (sometimes referred to as a "convergence"), which may result in movement of the stopping and/or door frame. Such convergence may cause the door latch to become jammed or become unlatched, which allows the door to open for undesired flow of air through the doorway.

The doors disclosed in applicants' U.S. Pat. Nos. 4,082,331 and 6,032,986, incorporated herein by reference, address the aforementioned problem and offer generally satisfactory solutions. The present invention, however, represents an improvement with respect to the patented designs.

SUMMARY OF THE INVENTION

Among the several objects of this invention may be noted the provision of an improved door system for a mine stopping including an improved latch mechanism for holding a door of the system tightly closed during a mine convergence; and the provision of such a door system wherein the latch mechanism requires less effort to operate and thereby facilitates latching and unlatching of the door.

In one aspect, apparatus of this invention is a door system for closing a doorway in a mine stopping. The system comprises a door hinged adjacent the doorway for swinging relative to the stopping between a closed position and an open position swung outwardly away from the stopping, and a keeper mounted in fixed position relative to the doorway. The system further comprises a trigger-actuated latch mechanism including a detent engageable with the keeper for latching the door in its closed position and a trigger operably connected to the detent in a latched position. The mechanism is constructed and configured so that actuation of the trigger causes the detent to move from a latched position in which the detent engages the keeper for latching the door closed to an unlatched position in which the detent is disengaged from the keeper for allowing the door to be opened.

In another aspect of the invention, the detent is engageable with the keeper for latching the door in its closed position when the detent is in a latched, cocked position. The system further comprises a biasing member for biasing the detent to an unlatched, uncocked position and a sear for holding the detent in the cocked position. The trigger is operably connected to the sear for moving the sear away from the detent to thereby cause the detent to move from the latched, cocked position to the unlatched, uncocked position. The mechanism is constructed and configured so that upon actuation of the trigger, the detent remains in the unlatched, uncocked position at least until the door is opened.

In yet another aspect of the present invention, the trigger-actuated latch mechanism includes a quadrilateral linkage mounted on the door. The detent is on the linkage and is engageable with the keeper for latching the door in its closed position. The mechanism includes a trigger bar having a sear for receiving the detent and holding the detent in the latched position. Actuating the trigger causes the detent to move from a latched position in which the detent engages the keeper for latching the door closed to an unlatched position in which the detent is released from the sear for allowing the door to be opened.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
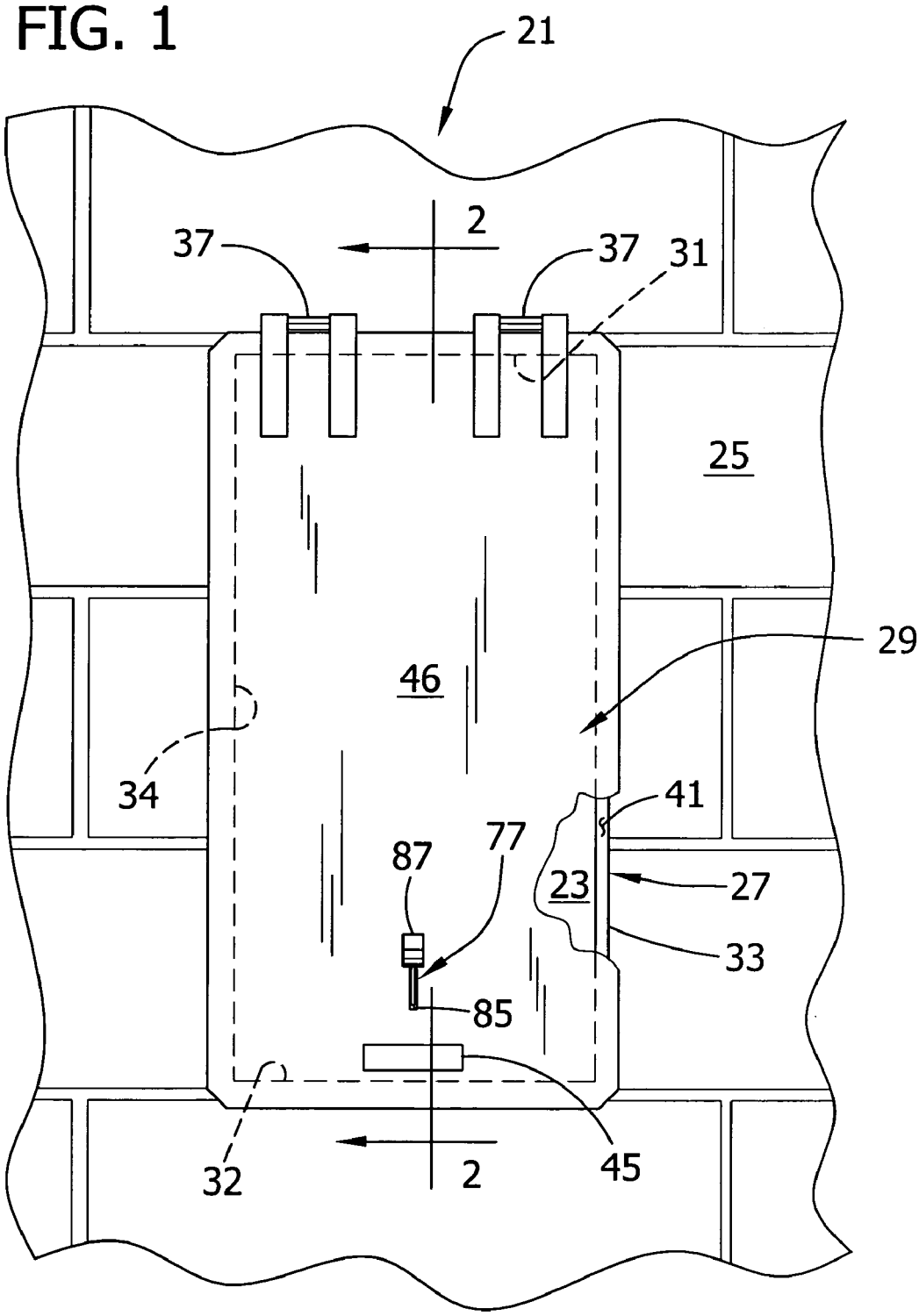
FIG. 1 is a front elevation of a door system of the invention installed in a mine stopping.
Figure 2:
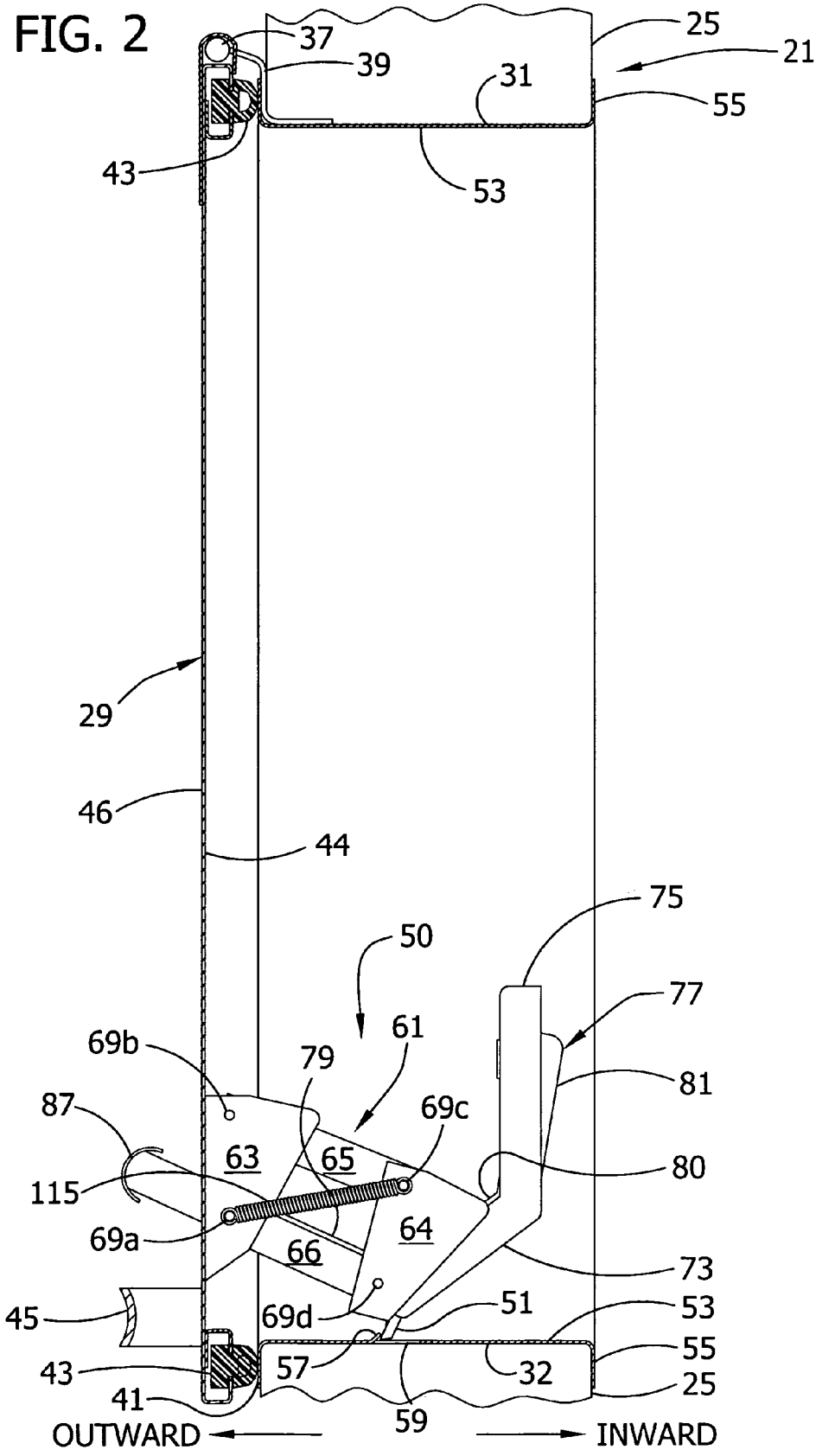
FIG. 2 is a vertical cross section on line 2-2 of FIG. 1.
Figure 3:
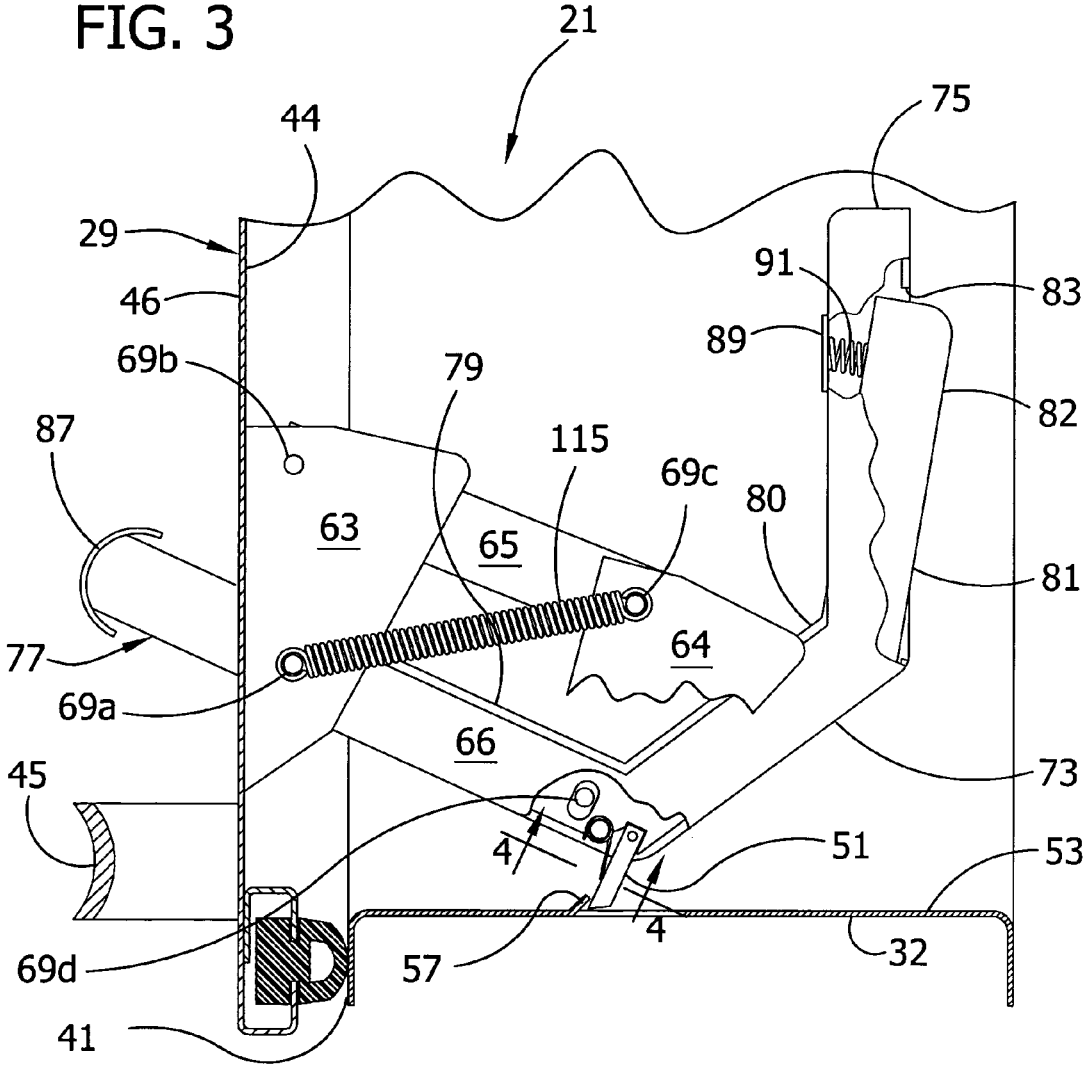
FIG. 3 is an enlarged fragmentary cross section similar to FIG. 2 showing a latch mechanism of the door system in a latched position, portions of certain components of the latch mechanism being broken away to illustrate details.
Figure 7:
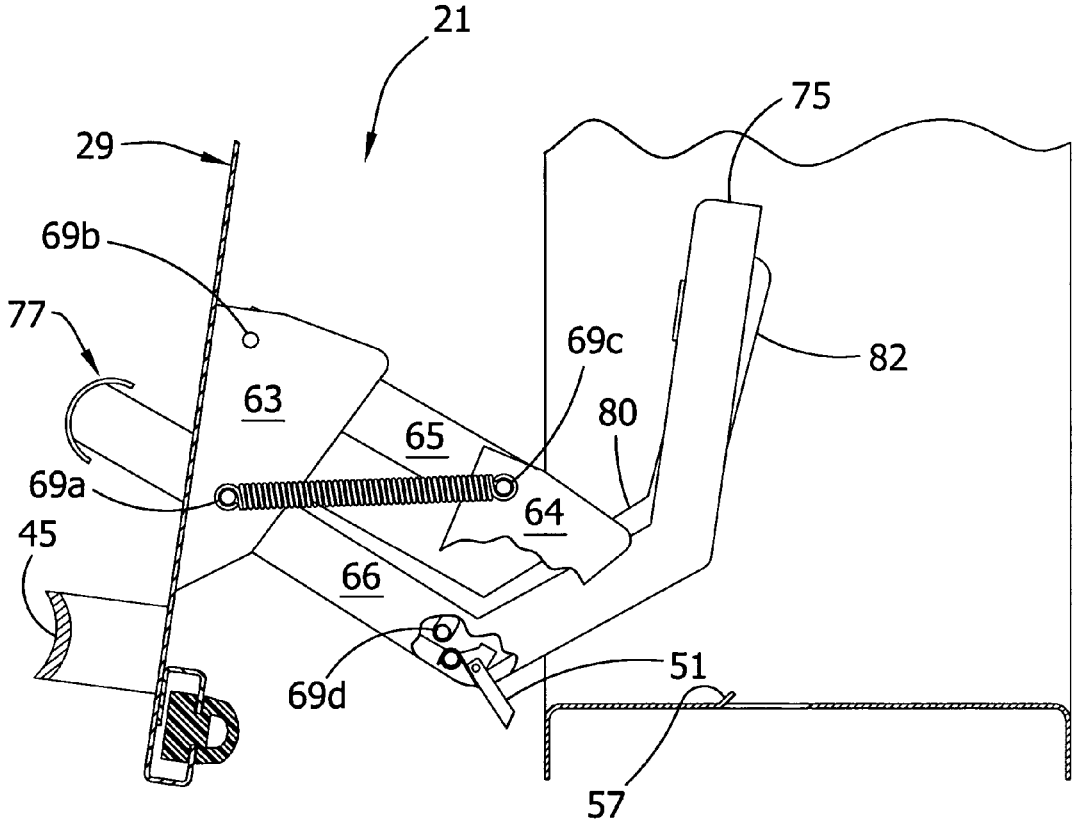
FIG. 7 is a development of FIG. 6 showing the door in an open position.
Figure 8:
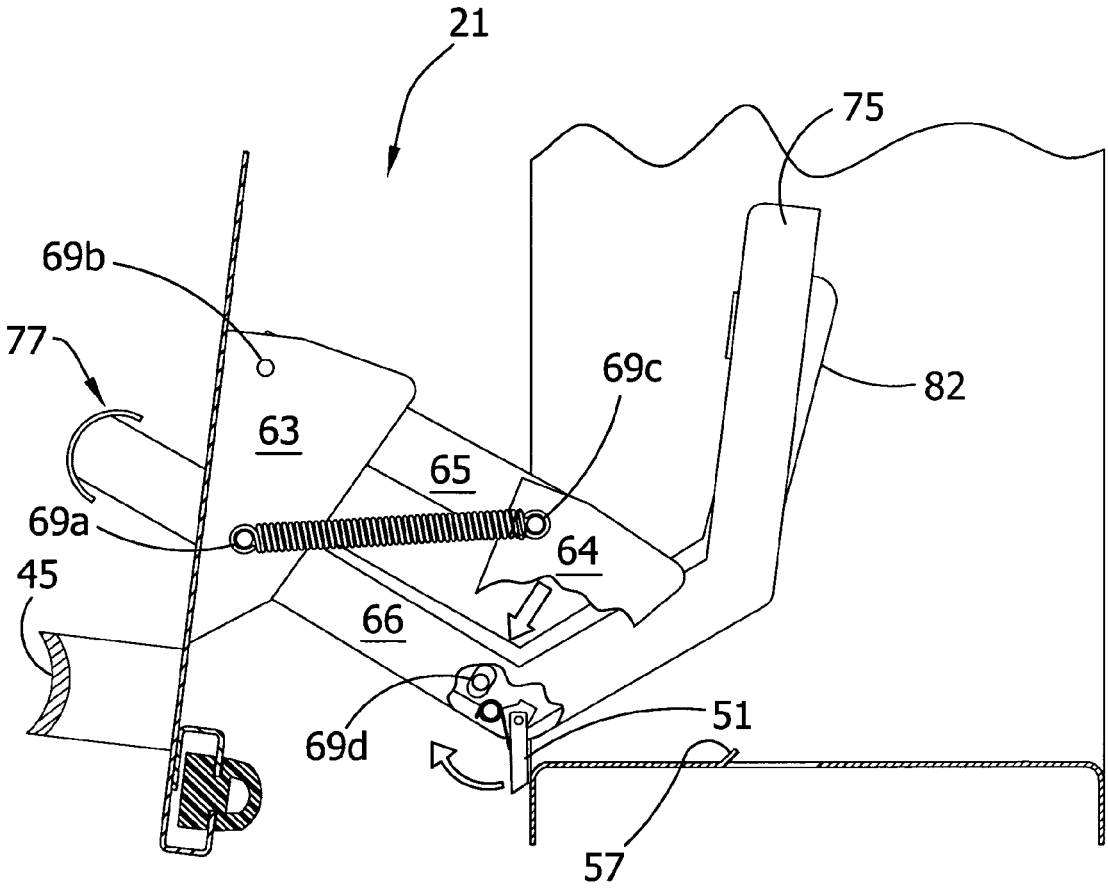
FIG. 8 is a development of FIG. 7 illustrating the door moving back toward the closed position and the latch mechanism during re-cocking.
Figure 9:
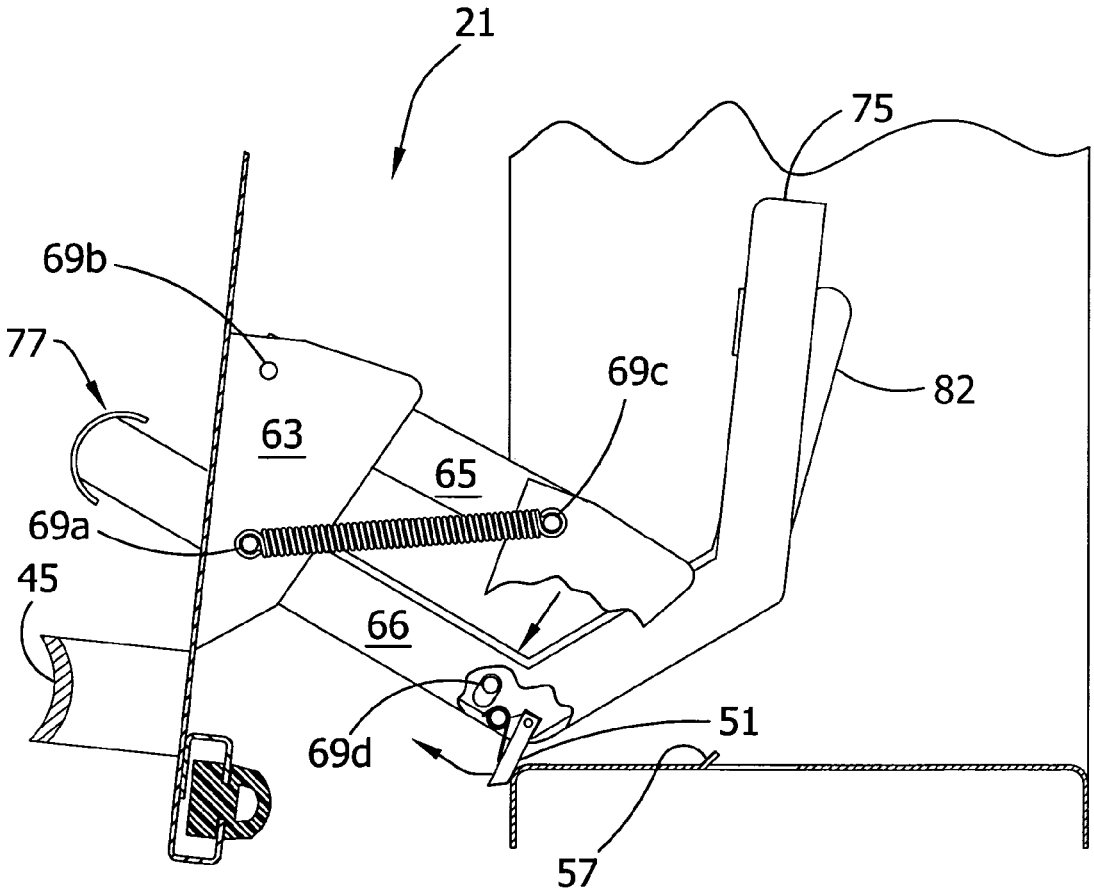
FIG. 9 is a development of FIG. 8 showing the latch mechanism re-cocked.

Referring now to the drawings, FIGS. 1-3 show a door system of the present invention generally designated 21, for closing a doorway 23 in a mine stopping 25. The door system 21 preferably includes a rectangular door frame, generally designated 27, and a door, generally designated 29, hinged on the door frame. The door frame 27 has opposing top and bottom horizontal frame members, designated 31 and 32, respectively, and two opposing vertical right and left side frame members, designated 33 and 34, respectively. The door 29 is supported at its upper end by horizontal hinge pins 37 mounted on brackets 39 secured to the top frame member. The door 29 swings on the hinge pin 37 relative to the door frame 27 between a closed position (FIGS. 1-3 and 5-6) engaging a face 41 of the frame around the doorway 23 and an open position (FIGS. 7-9) swung outwardly away from the frame. Preferably, a rubber seal 43 is attached to an inward face 44 of the door 29 for sealing against the frame face 41 all around the door frame 27 when the door is closed. An outward handle 45 is secured to an outward face 46 of the door 29 adjacent a bottom edge of the door. The door system 21 also includes a latch mechanism, generally designated 50, operable to latch the door 29 closed. As will be further described below, the mechanism 50 includes a detent 51 movable from a latched, cocked position (FIGS. 2-3) to an unlatched, uncocked position (FIGS. 6-7) and further to an unlatched but cocked position (FIG. 9).

Referring to FIGS. 1-2, each frame member 31-34 is in the shape of a channel having a relatively wide web 53 and a pair of opposing parallel flanges 55. The webs 53 of the four frame members 31-34 combine to define the rectangular doorway 23 through the stopping 25, and the flanges 55 of the four frame members combine to form continuous peripheral flanges which overlap the front and back faces of the stopping around the doorway. The bottom frame member 32 is preferably formed with a keeper 57 which slopes up from its web 53 and angles away from the door 29. The keeper 57 is positioned near the door 29 for engagement by the detent 51. (The keeper is often referred to in the trade as a "strike", and the detent as a "bolt".)

The latch mechanism 50 comprises a quadrilateral linkage generally designated 61. The linkage is similar to that shown in our co-assigned U.S. Pat. No. 6,032,986, which is incorporated herein by reference The linkage 61 includes a first pair of opposing spaced-apart links (hereinafter referred to as a fixed link 63 and an inward link 64) and a second pair of opposing spaced-apart links (hereinafter referred to as an upper link 65 and a lower link 66) having pivot connections with the first pair of links. The fixed link 63 is affixed, as by welding, to the inside face 44 of the door 29. The other links 64-66 are pivotally connected by pins 69*a-d* to form the quadrilateral linkage 61. The quadrilateral linkage 61 may be a trapezoid (as shown) or may be a parallelogram or any another quadrilateral shape. The lower link 66 is connected adjacent its outward end to the fixed link 63 and adjacent its inward end to the inward link 64. An angled extension 73 is rigidly attached, as by welding, to the inward end of the lower link 66 and forms an acute angle therewith. An inward handle 75 of the linkage 61 is similarly attached to the angled extension 73 at an acute angle therewith and extends generally parallel to the door 29. The upper link 65 is connected adjacent its outward end to the fixed link 63 and adjacent its inward end to the inward link 64. All four links 63-66, as well as the inward handle 75 and the angled extension 73 are suitably constructed of channel-shaped steel, although other shapes and materials are contemplated within the scope of the invention.

Figure 5:
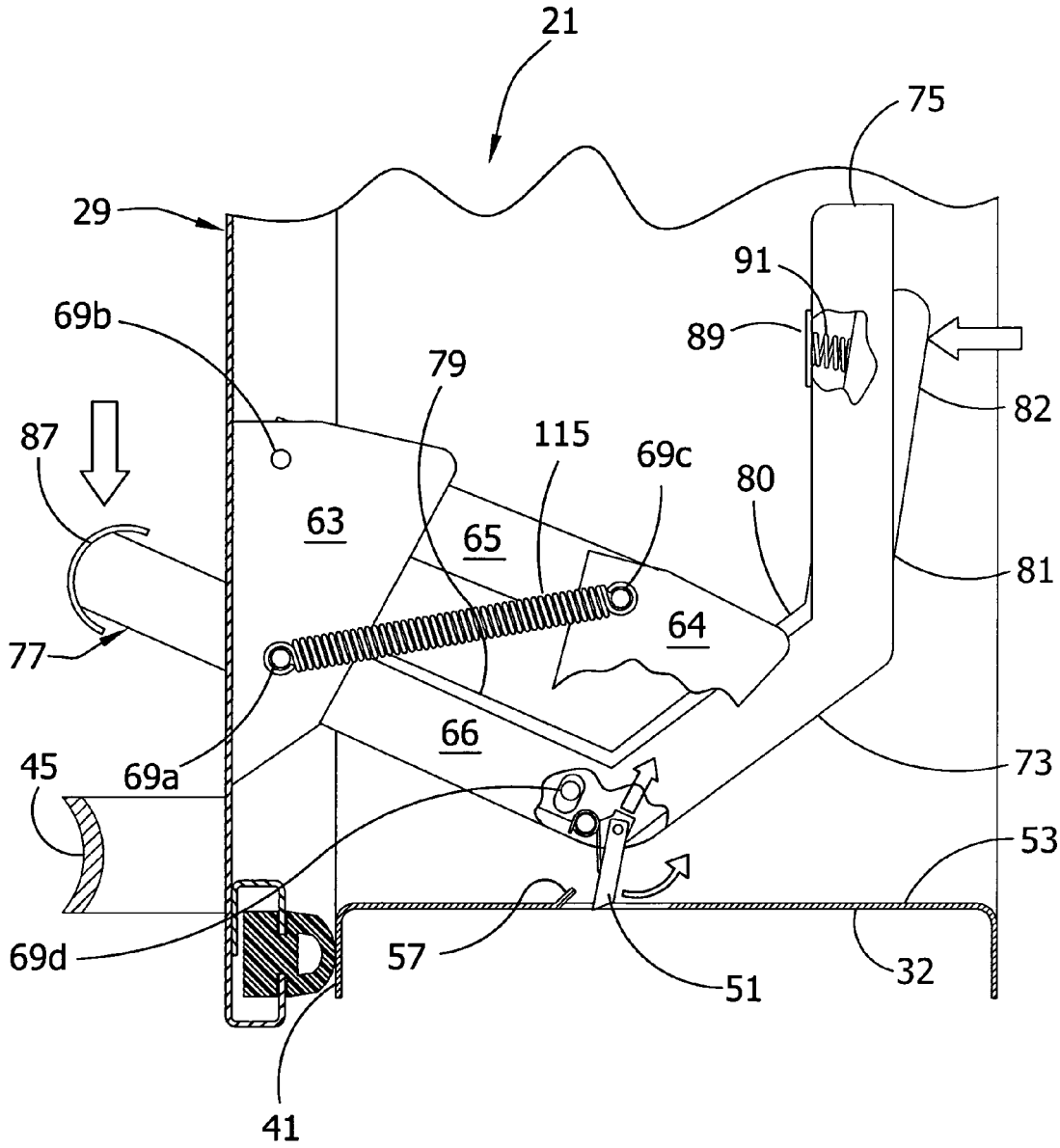
FIG. 5 is an enlarged fragmentary cross section similar to FIG. 3 showing the latch mechanism during actuation.

Referring to FIGS. 2-3 and 5, a trigger bar generally designated 77 is pivotally connected to the quadrilateral linkage 61 and operably connected to the detent 51 for holding the detent in its cocked, latched position and for releasing the detent for movement to its uncocked, unlatched position. In more detail, the trigger bar 77 of this embodiment is shaped to extend within the channels of the lower link 66 and the angled extension 73, and to extend through the inward handle 75. The trigger bar 77 is constructed of a single piece of metal and includes a central section 80 and lower leg 79 extending outwardly therefrom at an acute angle. The central section 80 and lower leg 79 are shaped complementary to the lower link 66 and angled extension 73, respectively. The trigger bar 77 further includes an inward leg 81 extending inwardly from the central section 80 and through a slot 83 in the inward handle 75. The inward leg 81 has an inward trigger 82 projecting from the slot 83. In this embodiment, the lower leg 79 of the trigger bar 77 is pivotally connected to the lower link 66 and the fixed link 63 by the pin 69*a* for pivoting of the trigger bar about the pin. The lower leg 79 of the trigger bar 77 extends further outwardly from the pin 69*a* through a hole 85 in the door 29. An outward trigger 87 is secured, as by welding, to an outward end of the lower leg 79. Opposite the inward trigger 82 is a spanner plate 89 secured to the flanges of the handle 75. A trigger spring 91 is interposed between the plate and the inward trigger 82 for biasing the trigger bar 77 toward the latched position.

Figure 4:
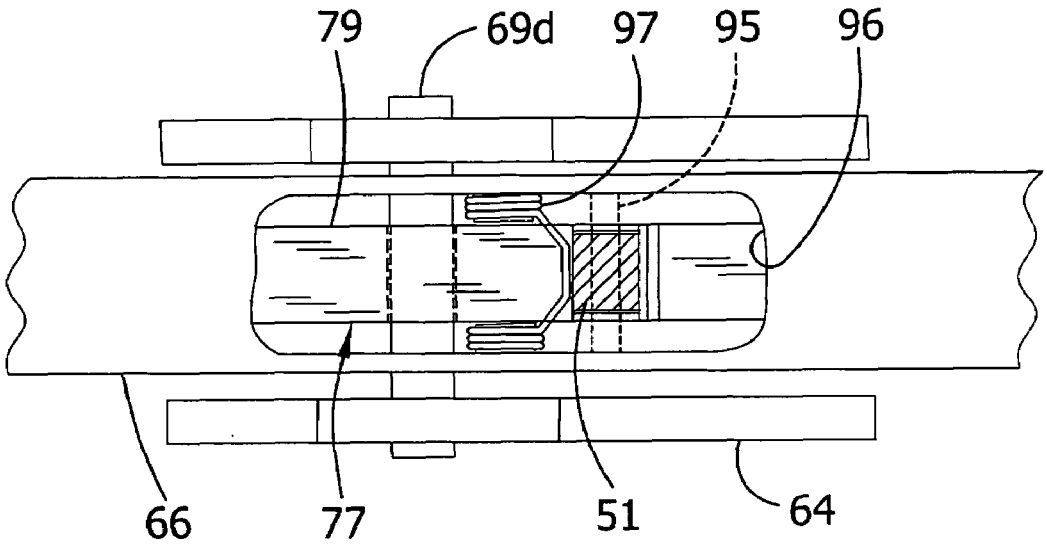
FIG. 4 is a cross section taken on line 4-4 of FIG. 3.

Referring to FIGS. 3-5A, the detent 51 is pivotally connected adjacent its upper end 51*a* to the lower link 66 of the quadrilateral linkage 61 by a detent pin 95 and extends through an opening 96 in the web of the lower link 66 (see FIG. 4). A lower edge 51*b* of the detent 51 is angled away from the door 29 to facilitate the detent sliding over the bottom frame member 32 and keeper 57 as the door is closing. A torsion-type detent spring 97 (generally, biasing member) for biasing the detent 51 has a first end 97*a* engaging the lower link 66 and a second end 97*b* engaging the detent. It has been found preferable for the detent spring 97 to bias the detent to the unlatching position to facilitate re-cocking of the detent and so that upon actuation, the detent will rotate to the uncocked, unlatched position.

Figure 5A:
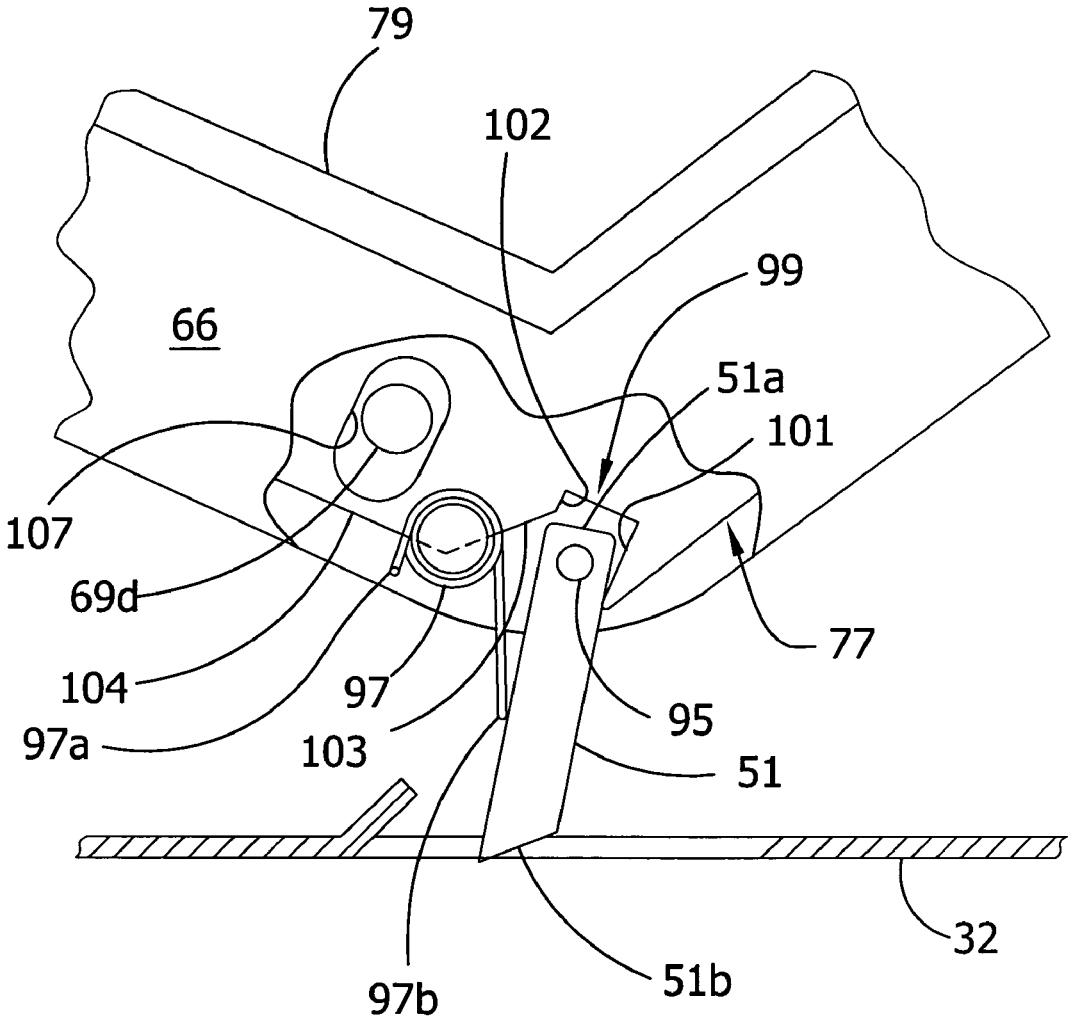
FIG. 5A is a further enlargement of FIG. 5.

As best shown in FIG. 5A, the trigger bar 77 includes a sear generally designated 99 shaped to receive and hold the upper end 51*a* of the detent 51 in the cocked, latched position. The sear 99 has an inward wall 101, an outward wall 102, and a chamfer 103 between the outward wall and a lower surface 104 of the lower leg 79 of the trigger bar 77. The outward wall 102 prevents pivoting of the detent 51 when the detent is in the cocked position (see FIG. 3). The height of the outward wall 102 is shorter than that of the inward wall due to the chamfer. The height of the outward wall is relatively short so that the detent 51 pivots (due to the spring 97) upon a relatively small movement of the sear 99 to thereby ease unlatching of the door 29. The chamfer 103 also enables the detent 51 to slip more easily into the sear 99 during re-cocking of the latch mechanism 50, as further described below.

The trigger bar 77 also includes a slot 107 for receiving the pin 69*d* which connects the inward link 64 and lower link 66. The slot 107 is sized and shaped to allow the trigger bar 77 to pivot, but only within a limited range. More particularly, the slot is sized and shaped so that once the detent 51 is released from the sear 99 (i.e., the detent clears the outward wall and pivots to the uncocked, unlatched position shown in FIGS. 6-7), the trigger bar cannot be pivoted significantly further. The trigger spring 91 may also serve to limit the pivotal movement of the trigger bar 77.

The trigger bar 77 is suitably made of stamped sheet metal, preferably steel. More preferably, the trigger bar is sized and shaped such that it may be made using a single press hit to minimize the cost of tooling and manufacture. The trigger bar 77 is preferably constructed of sheet metal having a thickness of between about 0.03 and about 0.25 inches, more preferably 14 gauge sheet metal defined to be between about 0.07 and about 0.087 inches. Generally, the sheet metal thickness is selected for the door size and expected pressure differential across the door 29 so that the trigger bar 77, especially the sear 99, remains functional over long-term use of the latch mechanism 50. The other elements of the door system 21 are preferably made of sheet metal of the same thickness. The force required to unlatch the mechanism 50 is preferably minimized by maximizing the lever arm of the triggers 82, 87, i.e., the distance between each trigger and the pin 69*a* joining the trigger bar 77 to the quadrilateral linkage 61.

As shown in FIGS. 2-3 and more fully described in the '986 patent, the length of the lower link 66 between its connections to the fixed link 63 and inward link 64 is preferably shorter than the length of the upper link 65 between its connections to the fixed and inward links. Also, when the latch mechanism 50 is in its latching position, the upper link 65 and the lower link 66 extend inwardly from the door 29 preferably at a generally downward angle toward the keeper 57. As a result of this configuration, the inward link in its latching position angles down and outward so that the tip of the detent 51 projects under the keeper 57 for more securely holding the door 29 closed. It will be understood that other linkage configurations are possible.

The quadrilateral linkage 61 includes means for biasing the detent 51 toward its latched position. In this embodiment, a coil spring 115 extends diagonally between opposite corners of the quadrilateral linkage 61 for maintaining the detent 51 in its latched position. The spring extends between the pin 69*c* connecting the upper link 65 and inward link 64 and the pin 69*a* connecting the fixed link 63 and lower link 66.

Figure 3A:
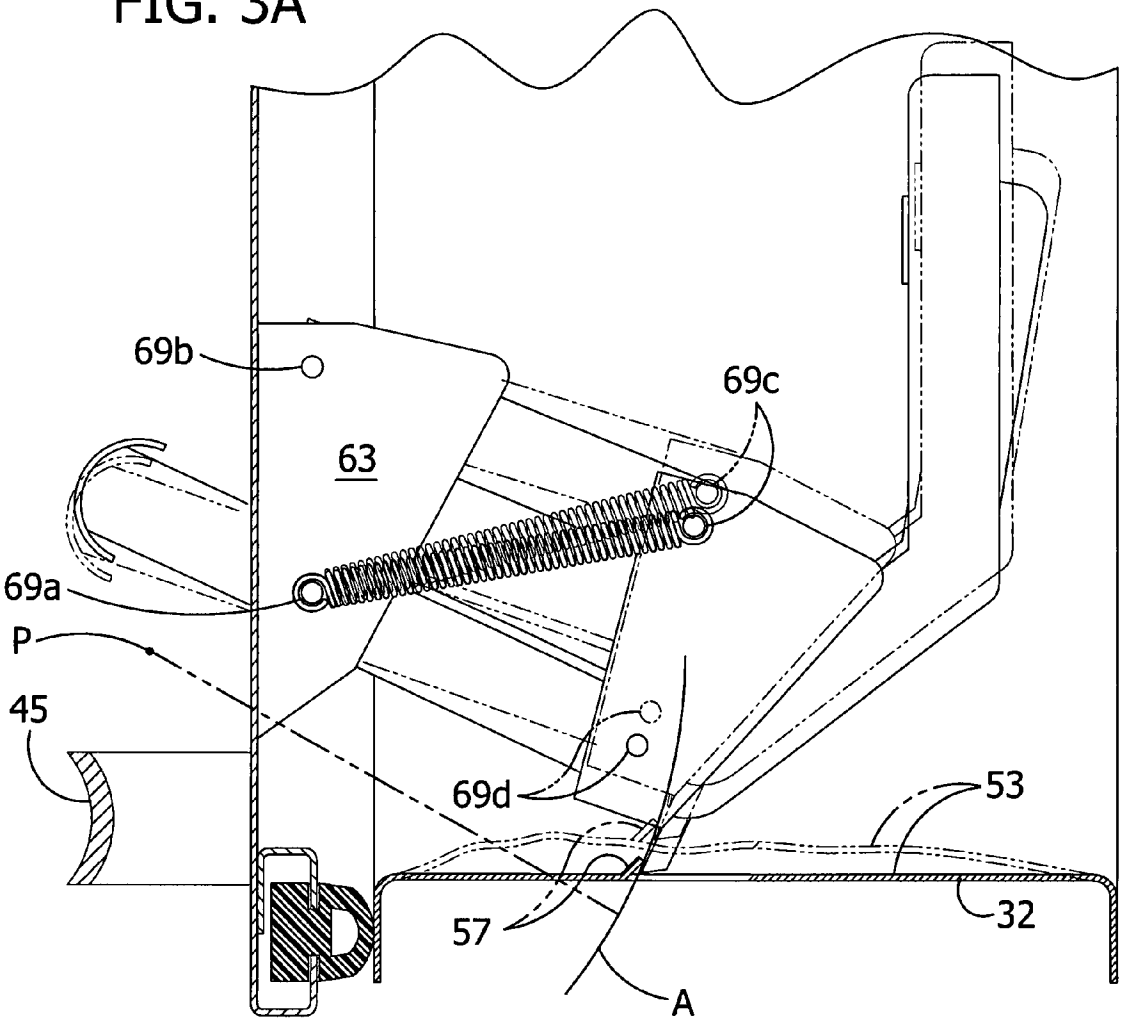
FIG. 3A is similar to FIG. 3 and shows the latch mechanism and door frame after a mine convergence.

In a mine convergence, the floor of the mine passage can heave up or otherwise shift, causing the top and bottom of the doorway 23 to converge toward one another. This convergence will typically cause the frame members 31-34 to deform and buckle, but not so much as to make the door 29 unusable. As illustrated in U.S. Pat. No. 6,032,986 and in FIG. 3A, a convergence can cause the bottom frame member 32 and keeper 57 to move in an upward path relative to the door 29 so that a distance between the keeper and a fixed point on the door changes. In some prior art designs, this change often caused the door to become unlatched or loose because the latch was unable to maintain a tight engagement with the keeper. The latch mechanism 50 of this invention, like the mechanism of U.S. Pat. No. 6,032,986, overcomes this problem because it is constructed and configured so that the detent 51 will remain in tight latching engagement with the keeper 57 even though there is a significant change in the position of the keeper. The latch mechanism 50 of the present invention is engineered and configured so that, during a convergence, the linkage 61 will rotate in a clockwise direction and the detent 51 will move along a path generally corresponding to the anticipated path of the keeper 57 so the separation between the keeper and the detent is kept to a minimum. As illustrated in FIG. 3A, the path is defined at least in part by an arc A centered on a point P spaced away (outward) from the door 29. As a result, the detent 51 is maintained in tight engagement with the keeper 57 before, during and after the convergence so that the door 29 remains tightly closed at all times. The angle of the detent 51 helps to keep the detent under the keeper 57 so that it remains in tight engagement with the keeper. The relative length of the links 63-66 and the location of their pivot connections can be adjusted in order to change the path to match the anticipated path of the keeper 57 during the convergence. The path may also be changed by varying the initial height of the latch mechanism 50 relative to the keeper 57. The center P of the arc A may be spaced away from the door 29 a distance varying from an inch or less to an infinite distance (resulting in the path being essentially a straight line).

Also, the distance between an uppermost end of the keeper 57 and the web 53 of the bottom frame member 32 may be shortened during a convergence. The latch mechanism 50, constructed and configured as described above, will maintain the door 29 tightly latched despite the shortened distance between the keeper 57 and the bottom frame member. The mechanism 50 is such as to maintain the door 29 tightly latched, and allow it to be opened, upon relative lateral shifting of the frame 27, e.g., if the top frame member 31 moves laterally while the bottom frame member 32 remains stationary.

Figure 6:
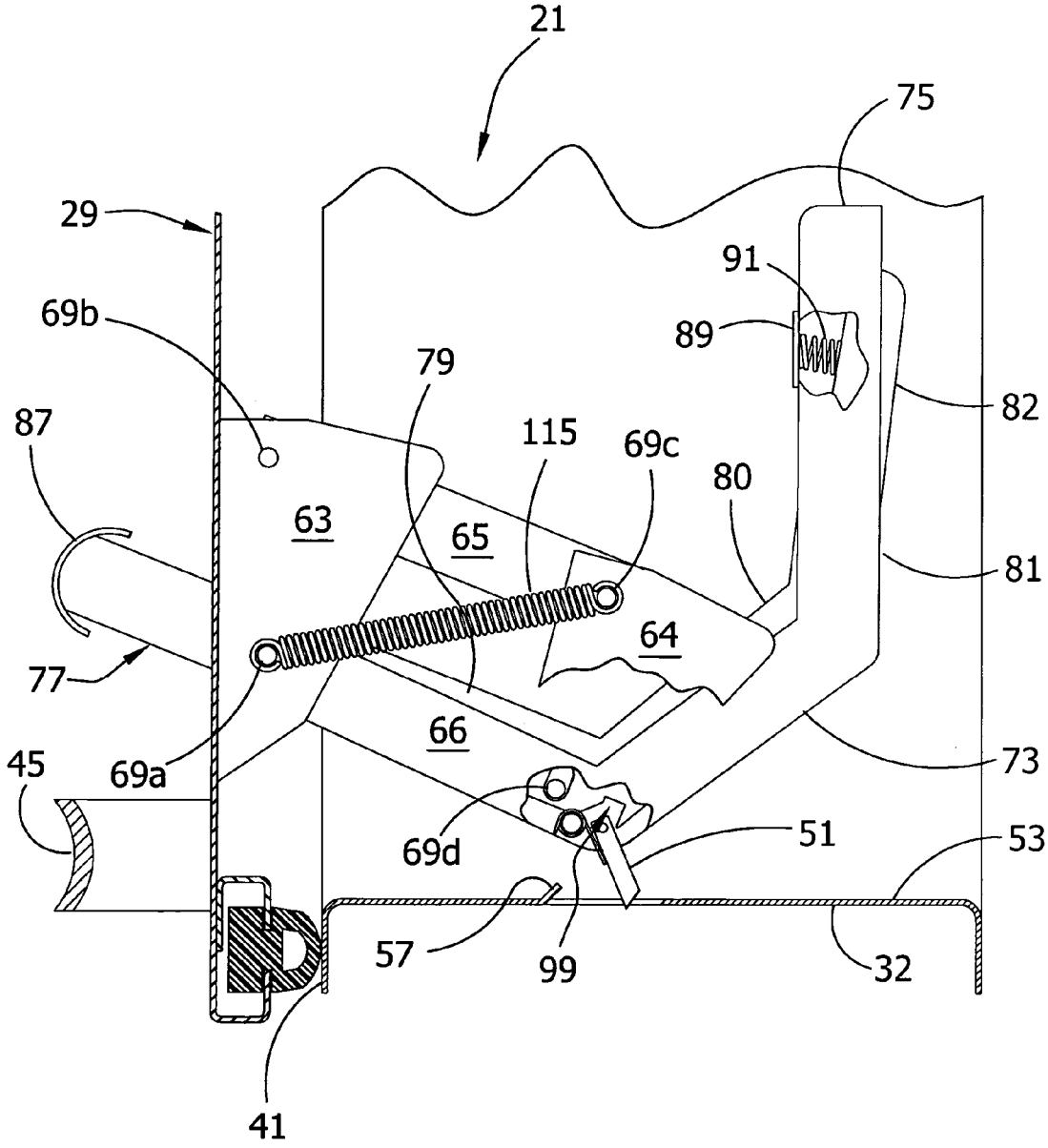
FIG. 6 is a development of FIG. 5 illustrating the latch mechanism in an unlatched, uncocked position.

Referring now to FIG. 5, a user can release the latch mechanism 50 from the outward side of the door 29, by actuating the outward trigger 87. The outward trigger is actuated by forcing the trigger generally downward (see arrow in FIG. 5). Alternatively, from the inward side of the door 29, the inward trigger 82 is actuated by moving the trigger generally outward (i.e., toward the door). Upon actuation, the detent spring 97 forces the detent 51 to rotate to the unlatched, uncocked position (FIG. 6). From the outward side, the door 29 can be moved to its open position (FIG. 7) by pulling on the outward trigger 87 or by pulling on the outward handle 45. From the inward side, the door 29 is moved to the open position by pushing on handle 75 or the inside face 44 of the door. Further, the detent spring 97 is sufficient to maintain the detent 51 in the uncocked position, even against the force of the trigger spring 91 (which biases the trigger bar 77 back toward the detent 51). Preferably, it is not necessary to manually pivot the quadrilateral linkage 61 to open the door 29 so as to reduce the effort required to open the door. Note though, that as the door 29 is pushed or pulled open, the quadrilateral linkage 61 may pivot as the detent 51 contacts the bottom frame member 32.

As the door 29 is moved back to its closed position, the detent 51 contacts the door frame 27 (bottom frame member 32, see FIG. 8) and pivots against the force of the detent spring 97 toward the cocked position. Simultaneously, the trigger bar 77 moves downward relative to the detent 51 due to the force of the trigger spring 91 (see upper arrow in FIG. 8). Upon the detent 51 pivoting into alignment with the sear 99, the sear slips over the upper end 51*a* of the detent to a position where the detent is completely received in the sear and held by the sear in its cocked position (FIG. 9). As the door 29 is rotated further inward, the quadrilateral linkage 61 will pivot upward, then will pivot back downward when the detent 51 clears the keeper 57. Upon clearing the keeper, the detent 51 is back in the cocked, latched position shown in FIGS. 2-3. Thus, the detent 51 is automatically re-cocked (re-set) as the door 29 is being closed. Further, the detent thereby resumes the cocked position immediately prior to resuming the latched position.

Advantageously, the latch mechanism 50 may be configured to move to the unlatching position with minimal actuating force on the trigger 82, 87. A more subtle advantage of the mechanism 50 is that the detent 51 remains unlatched while the user tries to open the door 29 without the user having to continue to apply force to the trigger. In other words, the detent 51 does not re-latch unless the detent is re-cocked by opening and closing the door 29. This is a helpful feature because the air pressure differential across the door 29 may be quite large, and consequently, the force required to open the door may be quite large as well. Experience has shown that the user often needs to re-position his hand on the door 29 (e.g., to get a better grip on the handle) after unlatching the detent or bolt in order to apply sufficient force to move the door to the open position. The detent or bolt of prior latch mechanisms would typically have re-latched upon the user re-positioning his or her hand, i.e., the detent would have slipped back into engagement with the keeper when the user released the handle. Thus, the user may have needed to unlatch the mechanism more than once. In preferred embodiments of this invention, the user can re-position his hand on the outward trigger 87 and pull on the trigger, or can release the trigger and pull on an auxiliary handle such as the outward handle 45.

Additionally, the handle of prior mine door latch mechanisms, such as that shown in U.S. Pat. No. 6,032,986, was used to unlatch the mechanism and to pull the door open against the force of the air pressure. The location of the handle at about the center of the door was not optimal in that the relatively short distance from the hinges reduced the moment arm and thereby increased the force necessary to open the door. In this invention, the outward handle 45 is preferably located at or adjacent the edge of the door 29 opposite the hinges, so that the distance from the hinges and thus the moment arm is much greater than the prior art handles. As noted above, the user can actuate the trigger and then open the door 29 by pulling the handle 45 disposed adjacent the edge of the door. Thus, the force used to unlatch the mechanism 50 and the force used to open the door 29 is less than that required by the prior art latch mechanism.

As various changes could be made in the above constructions without departing from the scope of the invention, it is intended that all matter contained in the above description or shown in the accompanying drawings shall be interpreted as illustrative and not in a limiting sense. For example, a trigger of the invention may alternatively be a push-button type release. A trigger of the invention may be operably connected to the sear 99 and/or the detent 51 by separate elements (e.g., a linkage, rather than a single bar) or by a cable. Also, the trigger bar 77 may have many other shapes within the scope of this invention. The biasing member or detent spring 97 may bias the detent 51 to the cocked, latched position, rather than the uncocked, unlatched position within the scope of the invention. Moreover, the detent need not necessarily have an uncocked position. Also, the detent spring 97 may be of any type, e.g., compression, within the scope of the invention.

The latch mechanism may alternatively be attached to the stopping 25 or to the door frame 27 and the keeper 57 may be on the door 29. The door 29 may be hinged directly on the stopping 25 or otherwise attached around the doorway 23 without including a door frame. While the door 29 of the described embodiment is hinged along its top, it will be understood that the door may be hinged at its bottom or along a side within the scope of this invention. The door 29, the brackets 39 and hinge pins 37 may be alternatively constructed and arranged so that the door is hinged on the web 53 and extends into the doorway 23, the seal 43 being arranged to seal against the webs. Such an arrangement is contemplated within the scope of the invention and is considered to be hinged "adjacent" the doorway 23.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

What is claimed is:

1. A combination of a mine stopping and a door system for closing a doorway in the mine stopping, said door system comprising:

a door hinged adjacent the doorway for swinging relative to the stopping between a closed position and an open position swung outwardly away from the stopping;

a keeper mounted in fixed position relative to the doorway; and a trigger-actuated latch mechanism including a detent engageable with the keeper for latching the door in its closed position and a trigger operably connected to the detent in a latched position, the detent in the latched position being biased toward an unlatched position, the mechanism being constructed and configured so that actuation of the trigger causes the detent to move from the latched position in which the detent engages the keeper for latching the door closed to the unlatched position in which the detent is disengaged from the keeper for allowing the door to be opened.

2. A combination as set forth in claim 1 wherein the latch mechanism includes a sear for holding the detent in the latched position and wherein actuation of the trigger causes release of the detent from the sear.

3. A combination as set forth in claim 2 wherein the detent is spring-biased to the unlatched position.

4. A combination as set forth in claim 1 wherein the latch mechanism is mounted on the door and comprises a quadrilateral linkage mounting the detent and adapted for maintaining the detent in the latched position even if the keeper moves relative to the door, as in a mine convergence.

5. A combination as set forth in claim 4 wherein the quadrilateral linkage includes a first pair of opposing spaced-apart links, a second pair of opposing spaced-apart links having pivot connections with said first pair of spaced-apart links, and a spring attached to the pivot connections at opposite corners of the linkage for maintaining the detent in the latched position.

6. A combination as set forth in claim 5 wherein the mechanism includes a sear for holding the detent in the latched position, the sear being pivotally connected to at least one of said spaced-apart links, and wherein actuation of the trigger causes pivotal movement of the sear for releasing the detent therefrom.

7. A combination as set forth in claim 6 wherein the detent is pivotally connected to at least one of the spaced-apart links and is biased to the unlatched position so that actuation of the trigger causes the detent to pivot to the unlatched position.

8. A combination as set forth in claim 7 wherein the detent and sear are sized and shaped so that the detent contacts the frame as the door is moved from the open position to the closed position for re-cocking the detent to a cocked position as the door is closed.

9. A combination as set forth in claim 8 wherein the detent is adapted to remain in the unlatched position after actuation of the trigger and prior to re-cocking to facilitate opening of the door against air pressure.

10. A combination as set forth in claim 8 wherein the sear includes a chamfer for facilitating re-cocking of the detent.

11. A combination as set forth in claim 8 wherein the trigger is spring-biased to facilitate re-cocking of the detent.

12. A combination as set forth in claim 1 wherein the trigger is located on an inward side of the door and wherein the mechanism further comprises a second trigger on an outward side of the door so that the mechanism is operable from both sides of the door.

13. A combination as set forth in claim 12 wherein the door includes an outward handle on its outward side, the mechanism being constructed and configured so that a user can actuate the second trigger and thereafter pull on the handle without the detent moving back to the latched position.

14. A combination of a mine stopping and a door system for closing a doorway in the mine stopping, said door system comprising:

a door hinged adjacent the doorway for swinging relative to the stopping between a closed position and an open position swung outwardly away from the stopping;

a keeper mounted in fixed position relative to the doorway; and a latch mechanism including a detent engageable with the keeper for latching the door in its closed position when the detent is in a latched, cocked position, a biasing member for biasing the detent to an unlatched, uncocked position, a sear for holding the detent in the cocked position, and a trigger operably connected to the sear for moving the sear away from the detent to thereby cause the detent to move from the latched, cocked position to the unlatched, uncocked position, the mechanism being constructed and configured so that upon actuation of the trigger, the detent remains in the unlatched, uncocked position at least until the door is opened.

15. A method of using the door of claim 14 comprising the steps in sequence:

actuating the trigger to cause the detent to move to the unlatched, uncocked position;

releasing the trigger; and thereafter pulling the door to the open position.

16. A method of using the door of claim 15 further comprising closing the door after the door has been pulled open to re-cock the mechanism so that the detent is re-cocked and prepared for actuation.

17. A combination as set forth in claim 14 wherein the trigger is located on an inward side of the door and wherein the mechanism further comprises a second trigger on an outward side of the door so that the mechanism is operable from both sides of the door, and wherein the door includes an outward handle on its outward side.

18. A method of opening the door of claim 17 including actuating the trigger to cause the detent to move to the unlatched, uncocked position, releasing the trigger and thereafter pulling on the outward handle to move the door to the open position.

19. A door system for closing a doorway in a mine stopping, said door system comprising:

a door hinged adjacent the doorway for swinging relative to the stopping between a closed position and an open position swung outwardly away from the stopping;

a keeper mounted in fixed position relative to the doorway; and a trigger-actuated latch mechanism including a quadrilateral linkage mounted on the door, a detent on the linkage and engageable with the keeper for latching the door in its closed position, and a trigger bar having a sear for receiving the detent and holding the detent in the latched position, wherein actuating the trigger causes the detent to move from a latched position in which the detent engages the keeper for latching the door closed to an unlatched position in which the detent is released from the sear for allowing the door to be opened.

20. A door system as set forth in claim 19 wherein the detent is pivotally connected to at least one of the spaced-apart links and is biased to the unlatched position so that actuation of the trigger causes the detent to rotate to the unlatched position.

21. A door system as set forth in claim 19 wherein the quadrilateral linkage includes a first pair of opposing spaced-apart links, a second pair of opposing spaced-apart links having pivot connections with said first pair of spaced-apart links, and a spring attached to the pivot connections at opposite corners of the linkage for maintaining the detent in the latched position.

22. A door system as set forth in claim 19 wherein the detent is cocked when in the latched position, is movable to an uncocked position for moving the door to the open position and is movable to an unlatched, cocked position when the door is moved from the open position to the closed position.

23. A door system as set forth in claim 22 wherein the detent and the sear are constructed and configured so that the detent contacts the frame as the door is moved to the closed position for re-cocking the detent to a cocked position in the sear as the door is closed.

24. A door system as set forth in claim 23 wherein the detent is biased to the unlatched position and the trigger bar is biased toward the detent so that the sear is forced toward the detent to facilitate re-cocking of the detent.

25. A door system as set forth in claim 24 wherein the detent remains in the unlatched position after actuation of the trigger without continued force against the trigger to facilitate opening of the door against air pressure.

26. A door system as set forth in claim 24 wherein the sear includes a chamfer for facilitating re-cocking of the detent.

27. A door system as set forth in claim 19 wherein the trigger extends through the door such that the trigger is operable from both sides of the door.

28. A door system adapted for closing a doorway in a mine stopping, said door system comprising:

a door adapted to be hinged adjacent the doorway for swinging relative to the stopping between a closed position and an open position swung outwardly away from the stopping;

a keeper adapted to be mounted in fixed position relative to the doorway; and a trigger-actuated latch mechanism including a detent engageable with the keeper for latching the door in its closed position and at least two triggers operably connected to the detent in a latched position, one of the triggers being located on an inward side of the door and the other trigger being located on an outward side of the door so that the latch mechanism is operable from both sides of the door, the detent in the latched position being biased toward an unlatched position, the mechanism being constructed and configured so that actuation of either of the triggers causes the detent to move from the latched position in which the detent engages the keeper for latching the door closed to the unlatched position in which the detent is disengaged from the keeper for allowing the door to be opened, wherein the latch mechanism includes a sear for holding the detent in the latched position and wherein actuation of the trigger causes release of the detent from the sear.

29. A door system adapted for closing a doorway in a mine stopping, said door system comprising:

a door adapted to be hinged adjacent the doorway for swinging relative to the stopping between a closed position and an open position swung outwardly away from the stopping;

a keeper adapted to be mounted in fixed position relative to the doorway; and a trigger-actuated latch mechanism including a detent engageable with the keeper for latching the door in its closed position even during movement of the keeper relative to the door, and a trigger operably connected to the detent in a latched position, the detent in the latched position being biased toward an unlatched position, the mechanism being constructed and configured so that actuation of the trigger causes the detent to move from the latched position in which the detent engages the keeper for latching the door closed to the unlatched position in which the detent is disengaged from the keeper for allowing the door to be opened, wherein the latch mechanism includes a sear for holding the detent in the latched position and wherein actuation of the trigger causes release of the detent from the sear.

* * * * *